United States Patent [19]

Sakai et al.

[11] 4,050,861

[45] Sept. 27, 1977

[54] DIAPHRAGM PUMP

[75] Inventors: Toshimitsu Sakai; Tadashi Saitou, both of Toyota; Isamu Suzuki, Aichi, all of Japan

[73] Assignees: Toyota Jidosha Kogyo Kabushiki Kaisha, Toyota; Aisan Kogyo Kabushiki Kaisha, Obu, both of Japan

[21] Appl. No.: 574,876

[22] Filed: May 6, 1975

[30] Foreign Application Priority Data

May 30, 1974 Japan ..... 49-62376[U]

[51] Int. Cl.[2] ..... F04B 43/02; F01B 19/00

[52] U.S. Cl. ..... 417/471; 92/99

[58] Field of Search ..... 92/97, 99; 417/470, 417/471, 571, 413; 74/18.2

[56] References Cited

U.S. PATENT DOCUMENTS

| | | | |
|---|---|---|---|
| 2,083,673 | 6/1937 | Loeber | 74/18.2 |
| 2,645,414 | 7/1953 | Mairhofer | 417/571 |
| 2,980,068 | 4/1961 | Stelzer | 92/99 |
| 3,119,280 | 1/1964 | Mann | 92/99 |
| 3,385,173 | 5/1968 | Euga | 92/91 |

FOREIGN PATENT DOCUMENTS

| | | | |
|---|---|---|---|
| 533,245 | 11/1954 | Belgium | 92/99 |
| 653,404 | 12/1962 | Canada | 417/413 |
| 1,383,383 | 11/1964 | France | 417/471 |
| 294,818 | 11/1953 | Switzerland | 417/413 |
| 3,058 of | 1884 | United Kingdom | 92/91 |
| 292,203 | 6/1928 | United Kingdom | 92/97 |
| 513,737 | 10/1939 | United Kingdom | 417/471 |
| 908,816 | 10/1962 | United Kingdom | 417/471 |

*Primary Examiner*—William L. Freeh

*Attorney, Agent, or Firm*—Stevens, Davis, Miller & Mosher

[57] ABSTRACT

A diaphragm fluid pump comprises a diaphragm piston assembly having a flexible diaphragm interposed and hermetically clamped at the outer rim thereof between upper and lower housings. The flexible diaphragm is integrally provided with a flexible sealing member of which the outer rim is interposed and fluid-tightly clamped together with the outer rim of the diaphragm between the lower and upper housings and the inner rim is fluid-tightly secured to a portion of the piston assembly to seal a portion of the flexible diaphragm exposed within a lubrication oil chamber.

2 Claims, 4 Drawing Figures

DIAPHRAGM PUMP

BACKGROUND OF THE INVENTION

The present invention relates to a diaphragm fluid pump, and more particularly to an improvement of a diaphragm piston assembly of a fluid pump of the type wherein lubrication oil is applied to the driving mechanisms of the diaphragm piston assembly.

In the conventional fluid pump of this type, a sealing member is installed between a portion of an operation rod of the piston assembly and the inner wall of a pump housing so that the flexible diaphragm made of a resilient material, such as rubber and the like, is protected from permeation of the lubrication oil to cause hardening and breakage of the diaphragm. The sealing means of the conventional type has, however, a drawback that the sealing feature of the sealing means becomes less in a short period of time since the sealing area against the operation rod is small.

SUMMARY OF THE INVENTION

It is the primary object of the present invention to provide an improved diaphragm fluid pump of which the flexible diaphragm is integrally provided with a flexible sealing member having a broad sealing area to maintain the sealing feature of the sealing member for a long period of time.

According to the present invention, a flexible diaphragm of a diaphragm piston assembly is integrally provided at the opposite side of a pumping chamber with a flexible sealing member of which the outer rim is interposed and fluid-tightly clamped together with the outer rim of the diaphragm between the coupled portions of upper and lower housings and the inner rim is fluid-tightly secured to a portion of the diaphragm piston assembly to seal the exposed portion of the diaphragm against lubrication oil.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
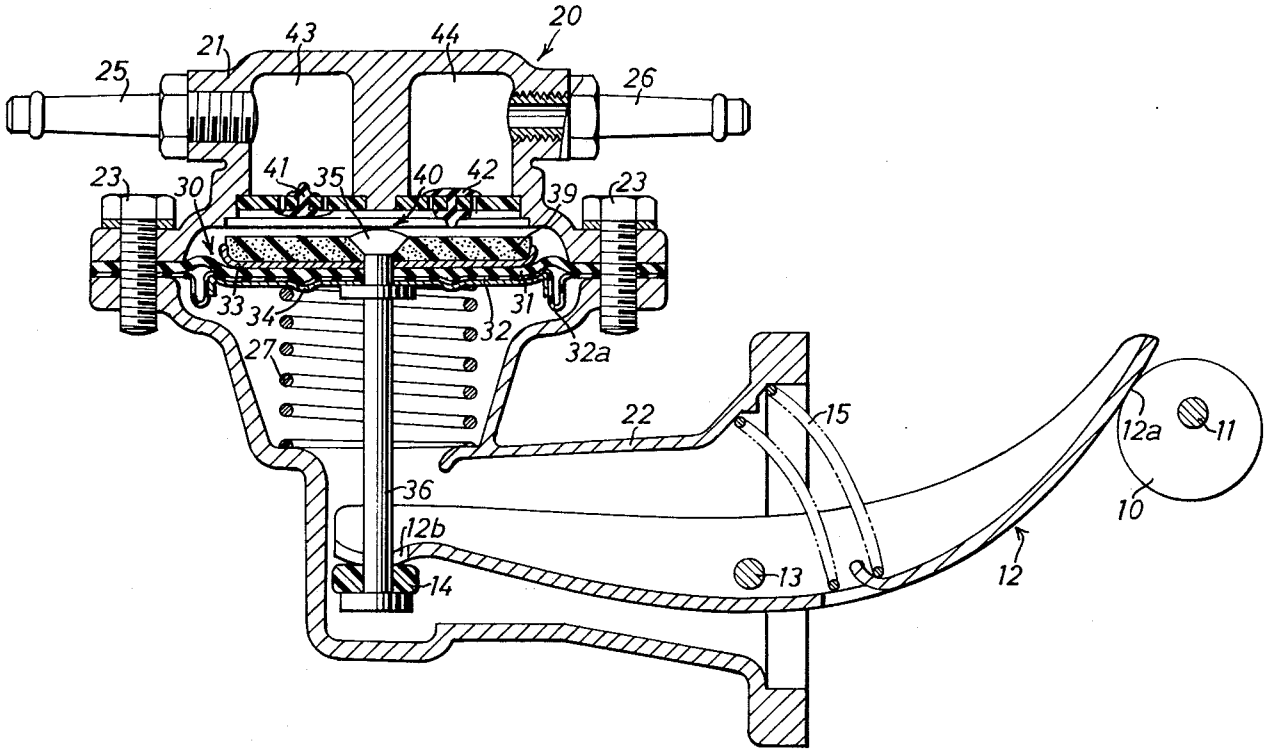
FIG. 1 is a vertical cross-sectional view of a diaphragm vacuum pump in accordance with the present invention.

Referring now to FIG. 1 of the accompanied drawings, disclosed is a preferred embodiment of a diaphragm vacuum pump 20 in accordance with the present invention. An eccentric cam 10 is fixed on a pump driving shaft 11 driven by the prime engine of a vehicle. A rocker arm 12 is swingably journalled by a pivot pin 13 on the inner wall of a lower housing 22 of the diaphragm vacuum pump 20. This rocker arm 12 engages at its outer end **12*a* the cam face of the eccentric cam 10 and at its inner end 12*b* the lower end of an operation rod 36, which will be discussed hereinafter in detail, through a washer 14. Furthermore, this rocker arm 12 is constantly biased clockwise in the figure by a compressed spring 15 which is interposed between the inner wall of the lower housing 22 and a portion of the rocker arm 12**.

A diaphragm piston assembly 30 comprises a flexible disc diaphragm 31 of which the outer annular rim is interposed and hermetically clamped between the annular jointing edges of an upper housing 21 and the lower housing 22 by bolts 23, and a flexible disc sealing member 32 integrated with the bottom face of the diaphragm 31 and provided with an annular bellows **32*a* to enable integrated reciprocations of the sealing member 32 with the diaphragm 31. The diaphragm piston assembly 30 further includes the operation rod 36, the top end of which is airtightly and liquid-tightly connected to the diaphragm 31 and the sealing member 32 at the centers thereof by caulking 35 through a pair of upper and lower protector plates 33 and 34. The diaphragm piston assembly 30 is completed with a disc buffer member 39 adhered on the upper face of the upper protector plate 33**.

The sealing member 32 is made of flexible fabric materials covered with such anti-oil, anti-heat and liquid-tight coating as urethane rubber and the like. The outer annular rim of the sealing member 32 is interposed and fluid-tightly clamped together with the diaphragm 31 between the upper and lower housing 21 and 22. The central portion of the sealing member 32 is interposed and liquid-tightly clamped between the diaphragm 31 and the lower protector plate 34 by caulking 35 of the operation rod 36.

Above the diaphragm piston assembly 30 within the vacuum pump 20, provided is a pumping chamber 40 in communication with a suction chamber 43 and an exhaust chamber 44 respectively through a suction check valve 41 and an exhaust check valve 42. The suction chamber 43 is provided with a suction port 25 connected to, for instance, a vacuum cylinder (not shown in the figure) of a brake booster of the vehicle brake system. The exhaust chamber 44 is provided with an exhaust port 26. Under the diaphragm piston assembly 30, provided is a coil spring 27 interposed between the bottom face of the lower protector plate 34 and the inner wall of the lower housing 22 so as to constantly bias the operation rod 36 upwardly.

Hereinafter the operation of the vacuum pump 20 of the above-explained construction will be described. Rotation of the eccentric cam 10 driven by the prime engine swings the rocker arm 12 with its fulcrum at the pivot pin 13 by engagement between the rocker arm 12 and the cam face of the eccentric cam 10 and also by resilient force of the compressed spring 15 and the coil spring 27. The swinging movements of the rocker arm 12 is converted into reciprocation of the diaphragm piston assembly 30 by way of the operation rod 36. During the reciprocating operation of the diaphragm piston assembly 30, the sealing member 32 cooperates with the movements of the diaphragm 31 without producing stress therein. Thus, the reciprocation of the diaphragm piston assembly 30 is not disturbed by the sealing member 32. All through the operation of the piston assembly 30, the operation rod 36 reciprocates by the coil spring 27, keeping its constant engagement with the inner end **12*b* of the rocker arm 12 by way of the washer 14**.

Under the downward strokes of the diaphragm piston assembly 30, the suction check valve 41 opens and the exhaust check valve 42 closes to suck the air into the pumping chamber 40 through the suction port 25, the suction chamber 43 and the suction check valve 41. Meanwhile, under the upward strokes of the diaphragm piston assembly 30, the suction check valve 41 closes and the exhaust check valve 42 opens to exhaust the air from the pumping chamber 40 externally through the exhaust check valve 42, the exhaust chamber 44 and the exhaust port 26, thereby to produce vacuum within the pumping chamber 40.

While the diaphragm vacuum pump 20 is in its operation, under the diaphragm piston assembly 30, lubricating oil stored within the lower housing 22 is supplied to the engaging portions of the inner and outer ends **12*b* and 12*a* of the rocker arm 12, the washer 14 and the eccentric cam 10. The lubrication is also conducted to the journalling portion of the pivot pin 13. In this instance, the lubricating oil is stirred and scattered up toward the exposed bottom side of the diaphragm piston assembly 30 by the rocker arm 12 but does not permeate to the diaphragm 31 by way of the imperviousness of the coating of the sealing member 32. Furthermore, no oil permeation to the diaphragm 31 is permitted from the inner and outer annular rims of the sealing member 32 since these portions are pressedly held liquid-tightly in broad areas by the upper and lower housings 21 and 22 and the caulking 35 of the operation rod 36**.

Figure 2:
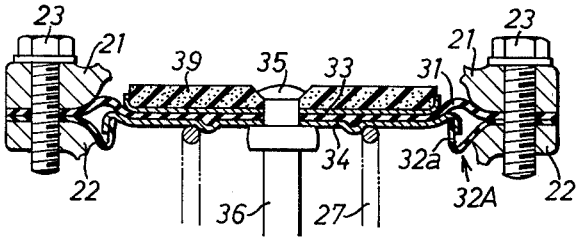
FIG. 2 is a fragmentarily vertical cross-sectional view of a diaphragm vacuum pump of another embodiment of the present invention.

Another preferred embodiment of the present invention is disclosed in reference to FIG. 2. In this embodiment, the flexible disc sealing member 32 of the previous embodiment is replaced with an annular sealing member 32A. The outer rim of the annular sealing member 32A is interposed and liquid-tightly clamped between the upper and lower housings 21 and 22 together with the diaphragm 31. The inner annular rim of the sealing member 32A is liquid-tightly adhered on the outer rim edges of the lower protector plate 34 by anti-oil and anti-heat glue. All other component parts and portions remain unchanged from the previous embodiment with the same reference numerals.

The only functional difference between the embodiments is that the annular sealing member 32A of the latter embodiment performs its sealing function with its annular face, meanwhile, the disc sealing member 32 of the previous embodiment performs its sealing function with its disc face. All other functions are just the same as those of the previous embodiment.

Figure 3:
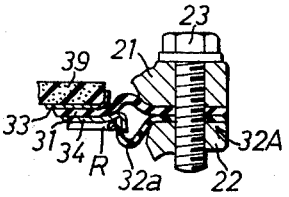
FIGS. 3 and 4 fragmentarily depict modifications of the diaphragm piston assembly of the vacuum pump shown in FIG. 2.
Figure 4:
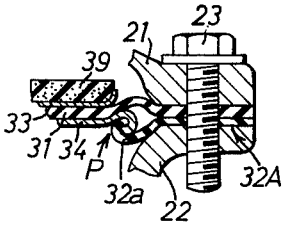

FIGS. 3 and 4 disclose a first and second modifications of the embodiment of FIG. 2. In FIG. 3, the first modification shows an additional use of a clamp ring R over the adhered portion of the annular sealing member 32A. In FIG. 4, the second modification shows provision of an annular caulking portion P along the outer rim of the lower protector plate 43, thereby to caulk liquid-tightly the inner rim edge of the annular sealing member 32A.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. In an air diaphragm pump comprising a lower housing mounted on a stationary structure for forming a lubrication oil chamber therein; an upper housing coupled with said lower housing for forming an air pumping chamber therein and provided thereon with an inlet port and an outlet port; a spring-loaded diaphragm piston assembly including a flexible diaphragm interposed and hermetically clamped at the outer periphery thereof between said housings to define said air pumping chamber and an operation rod for reciprocating said diaphragm assembly within said oil chamber; valve means assembled within said upper housing and including a first check valve to suck the air into said air pumping chamber through said inlet port and a second check valve to discharge the sucked air though said outlet port; and a driving mechanism assembled within said lower housing for operating said operation rod;

the improvement comprising:

upper and lower protector plates located respectively within said air chamber and said lubrication oil chamber for fluid-tightly connecting said flexible diaphragm at the center thereof to said operation rod, said plates having substantially planar portions;

a flexible disc sealing member integral with said flexible diaphragm on the side thereof facing said lubrication oil chamber and clamped between said diaphragm and said lower protector plate;

the outer periphery of said flexible disc sealing member being interposed and fluid-tightly clamped with the outer periphery of said diaphragm between said housings;

said flexible disc sealing member being interposed and fluid-tightly clamped between said lower protector plate and said diaphragm throughout the entire planar portion of said lower protector plate; and a buffer member secured to said upper protector plate to protect said valve means.

2. A diaphragm pump as set forth in claim 1, wherein said flexible disc sealing member includes an annular bellows located around the outer periphery of said lower protector plate.

* * * * *